US005669096A

United States Patent [19]

Worsham

[11] Patent Number: 5,669,096

[45] Date of Patent: Sep. 23, 1997

[54] BALL CLEANING SYSTEM

[75] Inventor: Jack W. Worsham, Greensboro, N.C.

[73] Assignee: Intertech Corporation, Greensboro, N.C.

[21] Appl. No.: 630,000

[22] Filed: Apr. 8, 1996

[51] Int. Cl.[6] ..... A63B 47/04

[52] U.S. Cl. ..... 15/21.2; 15/3.13; 15/302

[58] Field of Search ..... 15/3.13, 21.2, 15/302; 134/61, 133

[56] References Cited

U.S. PATENT DOCUMENTS

| | | | |
|---|---|---|---|
| 3,083,389 | 4/1963 | Wittek | 15/21.2 |
| 3,733,633 | 5/1973 | Gustafson | 15/21.2 |
| 3,820,183 | 6/1974 | Gustafson et al. . | |
| 4,181,996 | 1/1980 | Hollrock . | |
| 4,192,034 | 3/1980 | Knepper, Jr. . | |
| 4,881,287 | 11/1989 | Knez . | |
| 4,970,746 | 11/1990 | Brackmann . | |
| 5,228,168 | 7/1993 | Hollrock | 15/302 |
| 5,353,822 | 10/1994 | Gutterman | 134/133 |
| 5,361,440 | 11/1994 | Buchbinder | 15/21.2 |
| 5,373,597 | 12/1994 | Worsham | 15/3.13 |
| 5,454,877 | 10/1995 | Worsham . | |
| 5,529,082 | 6/1996 | Weimer | 134/133 |
| 5,551,118 | 9/1996 | Yeh | 15/21.2 |

FOREIGN PATENT DOCUMENTS

| | | | |
|---|---|---|---|
| 0264462 | 4/1988 | European Pat. Off. | 15/21.2 |

OTHER PUBLICATIONS

Great Northwest Company flyer advertising ball washing machine—undated (one page).
Roh'lix Linear Activator Brochure—undated (four pages).
The Boss by LAD Industries—undated (two pages).
Ball Cleaner—Boing Cleaning Services—undated (one page).
PIT B.O.S.S. brochure—undated (two pages).
WASH-a-BALL brochure—undated-Ball Pit Services, Inc., (three pages).
S.O.S. Ball Maintenance Truck—undated (three pages).
Gazette Telegraph Newspaper article—undated (two pages).
GCF 2000HD Brochure—undated (two pages).
Drawing of Prior Art Ball Track—(Undated).

*Primary Examiner*—David Scherbel
*Assistant Examiner*—Randall Chin

[57] ABSTRACT

A ball cleaning system utilizes negative and positive pressures to urge ball travel to and from the ball washing compartment. The system described herein is particularly useful for "dry" pool balls which must be frequently moved and cleaned for sanitation and appearance purposes. Convergers and diverters increase the functionality of the system by allowing balls from multiple pools to be cleaned in an easy, convenient manner.

13 Claims, 7 Drawing Sheets

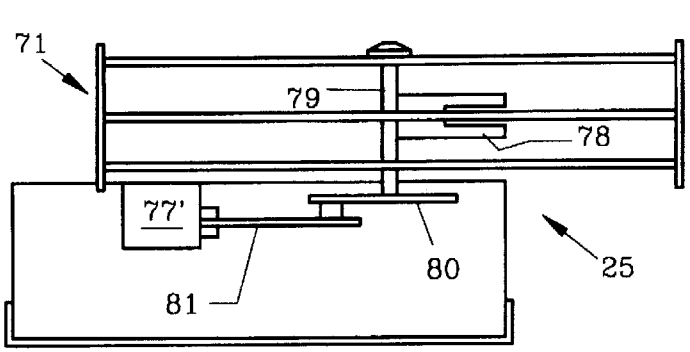
FIG. 5C
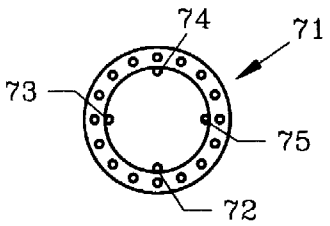
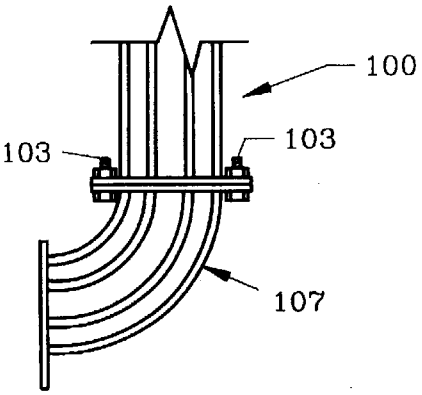
FIG. 10
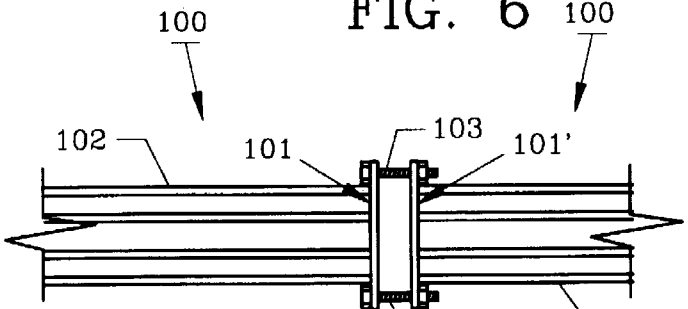
FIG. 6
FIG. 8
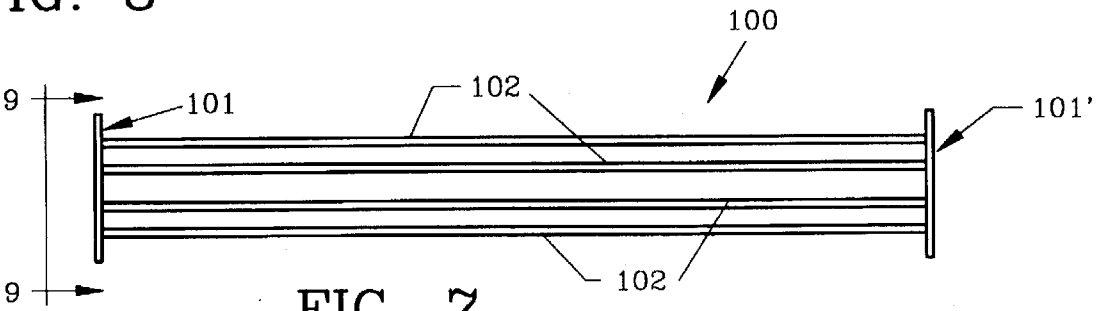
FIG. 7
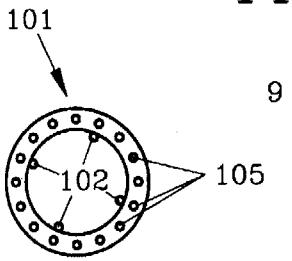
FIG. 9

BALL CLEANING SYSTEM

BACKGROUND OF THE INVENTION

1. Field Of The Invention

The invention herein pertains to the cleaning of "dry" pool balls as are used by children for recreational purposes. The system of the invention utilizes a ball washer which provides a negative pressure for drawing balls thereto and a positive pressure for exiting balls therefrom. A converger allows a single ball washer to handle a plurality of ball pools and a diverter redirects the balls from the washer selectively back to the plurality of ball pools.

2. Description Of The Prior Art And Objectives Of The Invention

The use of "dry" pools which are filled with lightweight plastic balls for play purposes by children has become increasingly popular in recent years. Such installations are available at fast food restaurants, playgrounds and other areas frequented by children. However, such ball pools can become unsanitary and as a result, pool owners must constantly remove the balls for cleaning and sterilization purposes. Ball cleaning machines have often replaced other methods of cleaning but certain ball cleaning machines still require manual handling and high labor expenses for the owner.

U.S. Pat. Nos. 5,373,597 and 5,454,877 demonstrate apparatus for cleaning balls 12 by transporting balls 12 manually from "dry" pools to cleaning machines. However, such operations, although effective, require much labor in the transportation and delivery and, therefore, lessens the operator's ability and desire to clean the balls frequently. There has thus been a need for a way to easily, automatically clean the pool balls in a fast, efficient manner with minimum manual labor. Certain prior ball cleaning systems have used ball tracks formed from plastic rods which are bent to desired shapes and configurations.

Thus, with the known disadvantages and problems associated with prior ball cleaning systems and devices, it is one objective of the present invention to provide a pool ball cleaning system which is relatively labor free yet which will clean a large quantity of pool balls in a short period of time.

It is still another objective of the present invention to provide a ball cleaning system which utilizes negative pressure from the ball washer to move the balls to the brush compartment of the ball washer for cleaning purposes.

It is yet another objective of the present invention to provide a ball washer which includes a simple bad ball detector for removing damaged balls.

It is still another objective of the present invention to provide a ball washer which includes a venturi for applying a positive pressure to the balls exiting the ball washer.

It is yet another objective of the present invention to provide a converger which allows selective removal of soiled balls from one or more ball pools.

It is yet a further objective of the present invention to provide a diverter for selective replacement of cleaned balls into one of a plurality of ball pools.

A further objective of the present invention is to provide a ball track which is relatively simple to manufacture and which can be adjustably lengthened or shortened to a variety of sizes and can be formed in either straight or curved configurations.

Various other objectives and advantages of the present invention will become apparent to those skilled in the art as a more detailed description is set forth below.

SUMMARY OF THE INVENTION

A children's play pool ball cleaning system is described setting forth the aforesaid objectives and advantages to provide a fast, easy and convenient manner of cleaning pool balls which become soiled from a series of pools. The ball system includes tubing attached to a ball washer which provides negative pressure for delivering balls to the washer. Such tubing is used to collect balls from the ball pools and is also used to direct the clean balls upwardly from the ball washer to a sufficient height. A diverter is then used to return the balls to a certain one of a selected number of ball pools as desired.

BRIEF DESCRIPTION OF THE DRAWINGS

FIG. 5C illustrates an end view of the ball outlet as shown along lines 5C—5C of FIG. 5A;

FIG. 6 depicts a schematic side elevational view of the diverter as shown in FIGS. 5A and 5B;

FIG. 7 shows a side elevational view of a typical linear track assembly;

FIG. 8 demonstrates a fragmented track assembly as joined to a similar fragmented track assembly as seen in FIG. 7.

FIG. 9 pictures an end view of the track assembly as seen in FIG. 7 along lines 9—9;

FIG. 10 features another track assembly having a curved configuration; and

DESCRIPTION OF THE PREFERRED EMBODIMENTS

Figure 1:
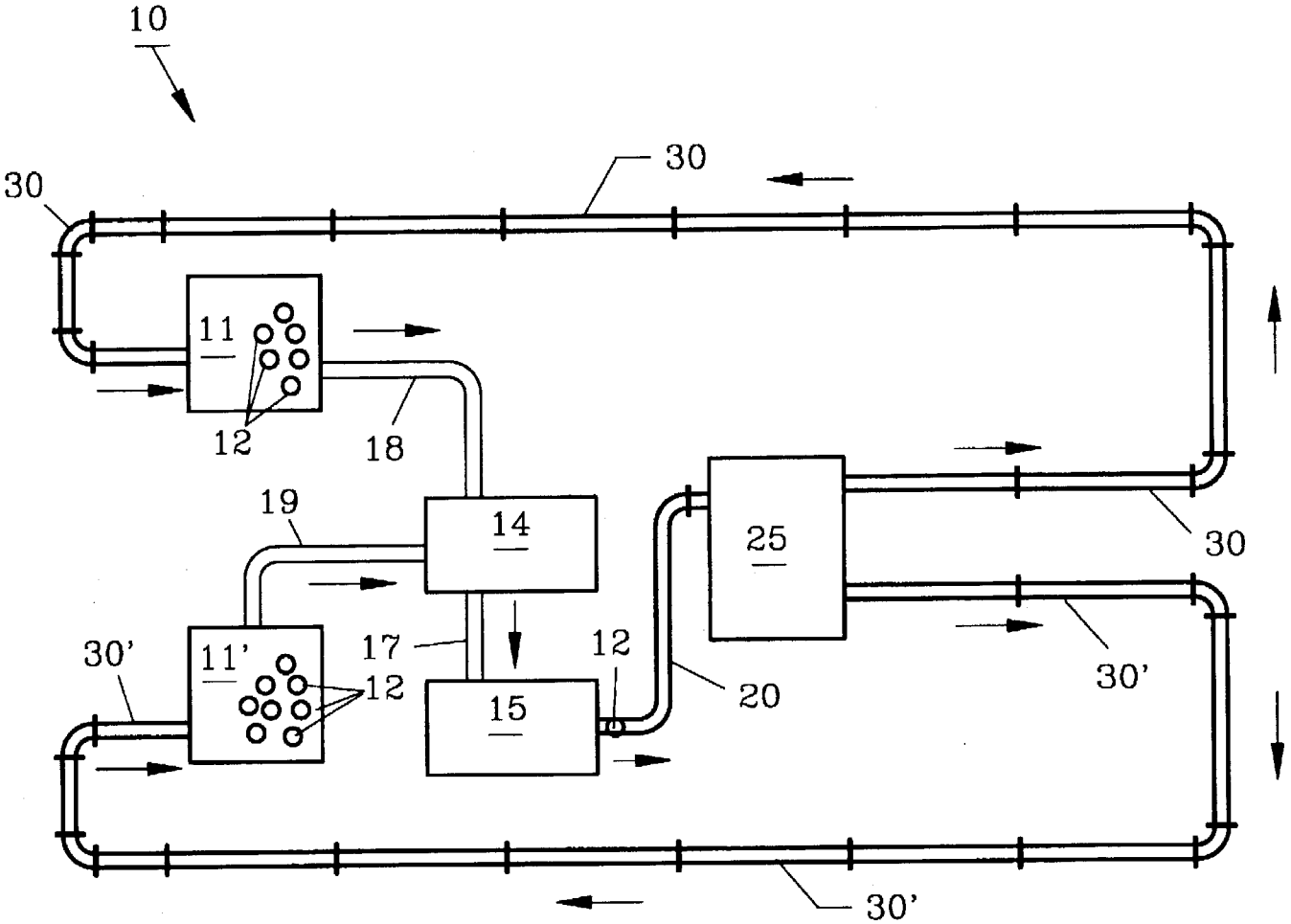
FIG. 1 illustrates a schematic ball cleaning system utilizing a pair of ball pools.
Figure 11:
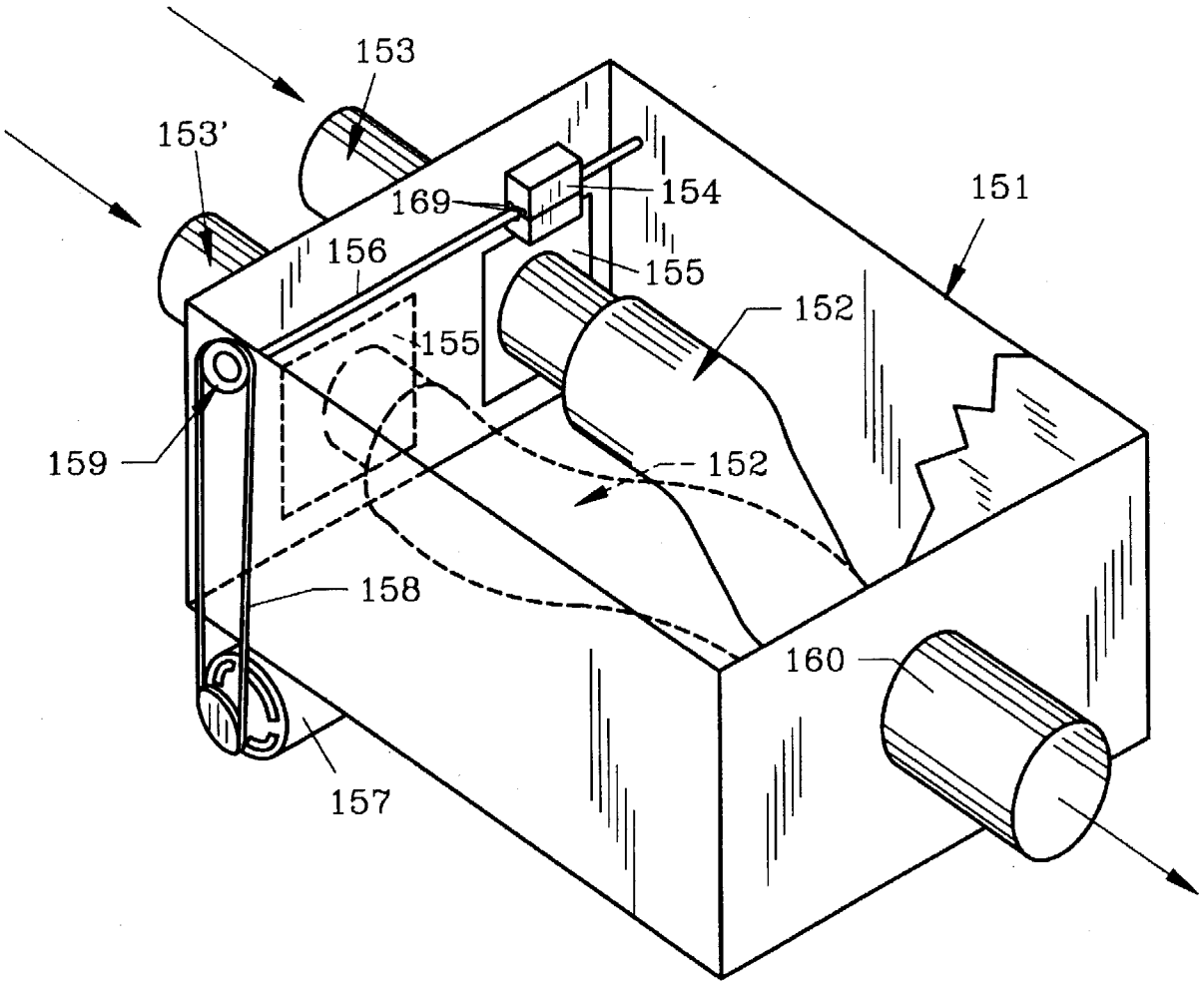
FIG. 11 provides a perspective view of the converger as used in the ball cleaning system with the top cover cut away for clarity.

The preferred form of the ball cleaning system is shown schematically in block fashion in FIG. 1 and includes a pair of separated ball pools for use by children. Both pools are connected by tubing to a converger which is negatively pressurized from the ball washer. Soiled balls which move from the pools are cleaned by the ball washer and are then vertically elevated under positive pressure to a diverter. From the diverter the balls roll along tracks by gravity where they are returned in clean, fresh condition to the ball pools. The preferred converger is illustrated in FIG. 11 and includes a pair of ball inlets and a single ball outlet for delivery of balls to the ball washer.

Figure 2:
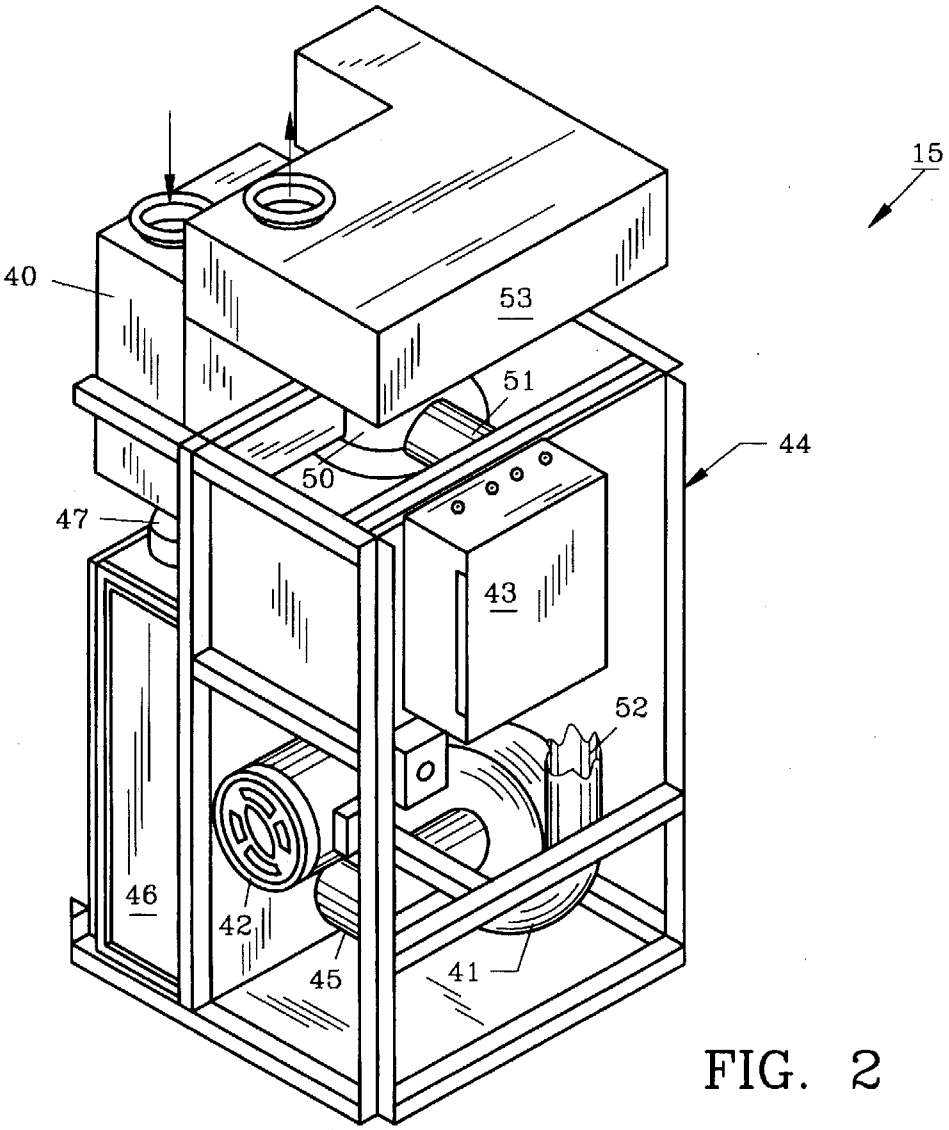
FIG. 2 demonstrates a perspective view of a ball washer with the side panels removed to expose the internal components.
Figure 3:
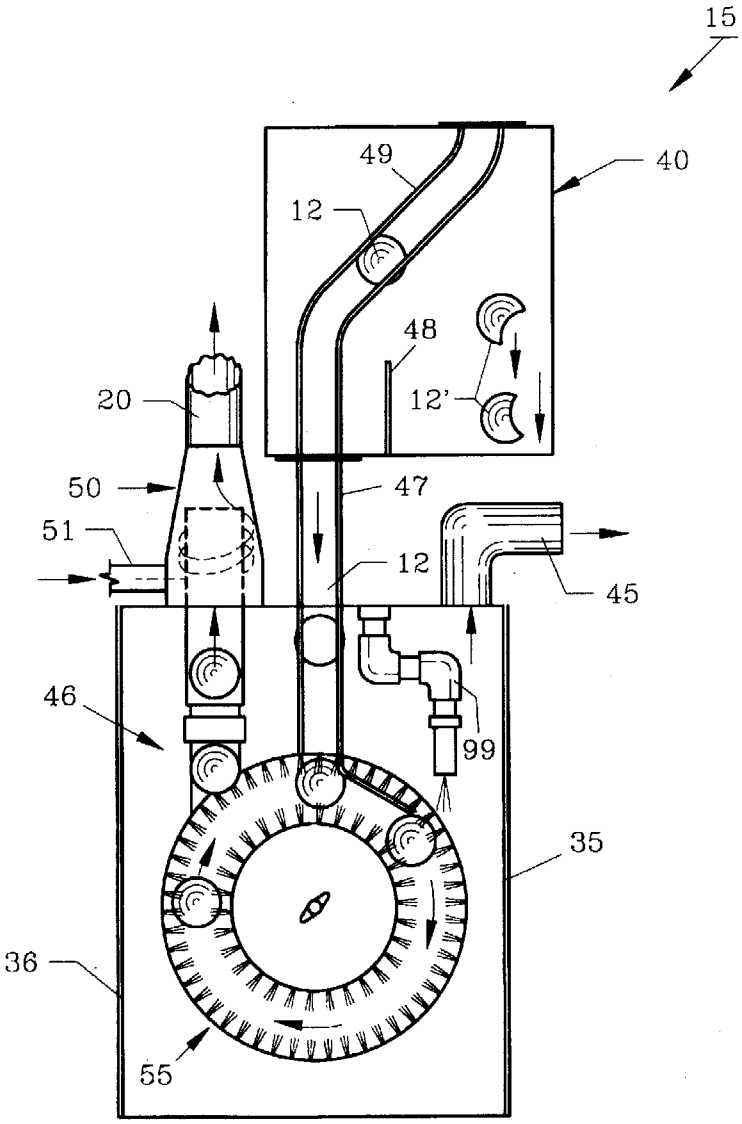
FIG. 3 shows a schematic side representation of the ball washer as seen in FIG. 2.
Figure 5B:
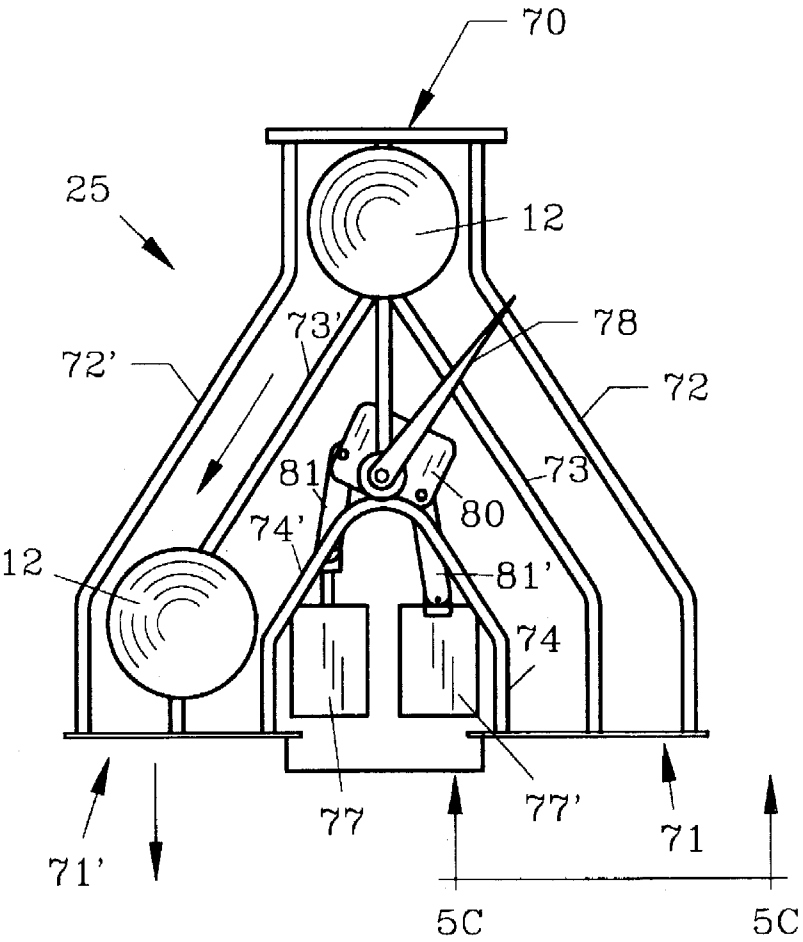
FIGS. 5A and 5B depict schematic top representations of the diverter illustrating use of different ball outlets.
Figure 5A:
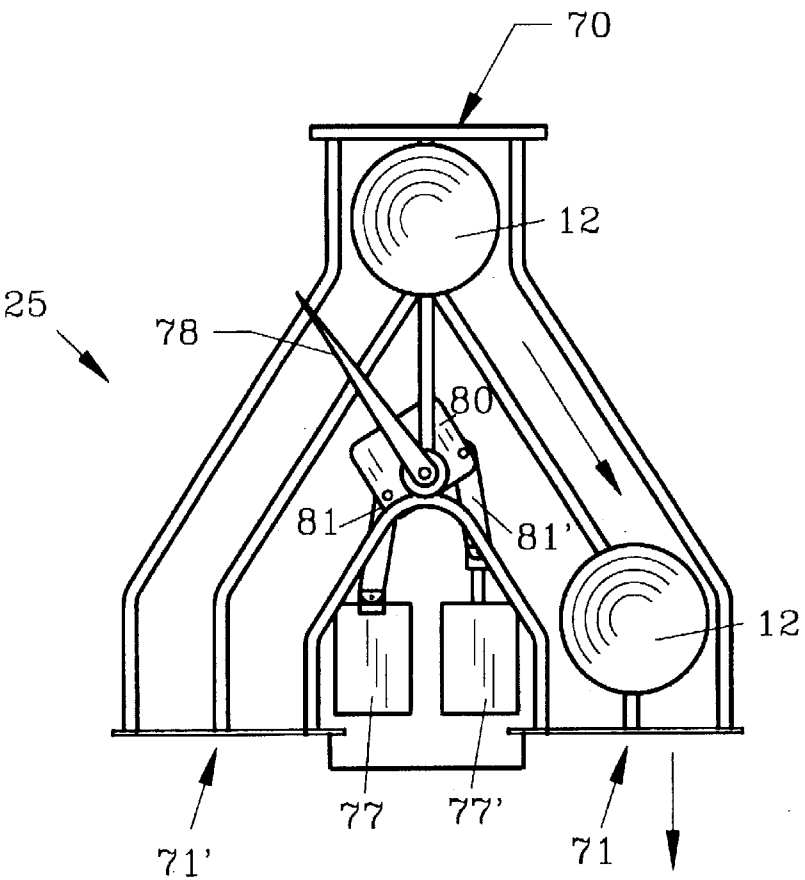

The preferred ball washer of the invention is best shown in FIGS. 2 and 3 and includes a sealed brush compartment which exerts a negative pressure on a ball detector. Positive pressure is exerted on a venturi therein by a fan contained within the ball washer cabinet. The balls are directed mechanically from the sealed washing compartment under negative pressure to the venturi, then under positive pressure to the drying chamber and then to a diverter for distribution to a pair of ball pools once they exit the diverter. The preferred form of the diverter is illustrated in FIGS. 5A, 5B and 5C, and includes a movable gate controlled by a pair of solenoids linked thereto.

The preferred track assembly of the invention is shown in FIG. 8 whereby a plurality of cylindrically shaped rods are joined to circular metal rod guides. Straight or curved track assembly can be joined together by bolts positioned through apertures in the rod guides to form a track assembly of desired length and configuration.

DETAILED DESCRIPTION OF THE INVENTION AND ITS OPERATION

For a better understanding of the invention and its use, turning now to the drawings, FIG. 1 demonstrates a schematic view of a typical "play pool" ball cleaning system 10, which includes a pair of ball pools, 11, 11'. Pools 11, 11' can be any of a variety of sizes filled with lightweight plastic pool balls 12 which may range from approximately 73–82 mm in diameter. Different diameter balls can be mixed within the system within the 73–82 mm range without concern. Playgrounds, fast-food restaurants and children's entertainment centers typically utilize play pools filled with lightweight balls 12 for children's fun and enjoyment. For sanitary and health purposes, balls 12 must frequently be cleaned by the pool owners and operators.

As further shown in FIG. 1, converger 14 is in communication with ball washer 15 by means of plastic tubing 17. Ball washer 15 applies negative pressure to tubing 17, through converger 14, and to tubing 18 and 19 as also shown in FIG. 1. Such negative pressure urges balls 12 from ball pools 11, 11' to converger 14 and on to ball washer 15 for cleaning purposes.

After cleaning, balls 12 are generally directed upwardly, through tubing 20 under positive pressure from ball washer 15 to a convenient, desired height, which may be 2.5–3.5 meters or more, where they are then, either by gravity or, optionally by continued positive pressure, delivered to diverter 25, after which balls 12 are gravity driven along tracks 30, 30' to the selected ball pool, 11 or 11'. As would be understood, in a system with only one ball pool utilized, converger 14 and diverter 25 would not be necessary as balls 12 would move from the ball pool to washer 15 in a simple, single path and return in a single path. Also, ball washer 15 as described herein has a single cleaning path and compartment, however, other ball washers could be utilized with multiple cleaning paths (multiple cleaning compartments) whereby additional ball pools, converters, diverters, tubing and track assemblies could be utilized for multiple, large scale operations.

Track 30 provides a return for ball pool 11 whereas track 30' returns balls to ball pool 11'. As seen and understood, tracks 30, 30' operate by gravity to allow balls 12 to roll from diverter 25 to ball pools 11, 11', whereas tubing 17, 18 and 19 operate under negative pressure. Tubing 20 operates under positive pressure.

Ball washer 15 is shown in FIG. 2 has its outer panels such as side panels 35, 36 which are formed from thin sheet metal, as seen in FIG. 3, removed to expose the inner components. Ball washer 15 includes ball detector 40 which receives incoming balls 12 as will be hereinafter more fully explained. Ball detector 40 is joined to converger 14 as seen in FIG. 1 by tubing 17 which is under a negative pressure generated by fan 41. Drying chamber 53 allows any excess water to be removed from balls 12 as they exit venturi 50. Fan 41 is a centrifugal fan driven by an electric motor 42. Motor 42 is controlled by electrical circuitry (not seen) within control box 43 attached to ball washer metal cabinet frame 44 which includes circuit breakers, on/off switches, power supply lines, circuit lights and conventional electrical circuits. As fan 41 operates, conduit 45 which is in fluid communication with sealed brush compartment 46, allows fan 41 to pull air from brush compartment 46 and from ball detector 40. Conduit 47 allows communication between brush compartment 46 and sealed ball detector 40. (Sealed as used herein refers to the prevention of undue leakage of the hermetic type.) Thus, fan 41 provides negative pressure to brush compartment 46 and detector 40 to urge balls 12 into brush compartment 46 such as from converger 14.

Once balls 12 have been washed and rinsed within brush compartment 46, they are mechanically directed, while under negative pressure, by the force of the rotating brush through venturi 50 which receives high velocity air through venturi conduit 51 from fan outlet 52 (shown in FIG. 2) to apply a positive pressure to venturi 50, thereby forcing balls 12 upwardly to drying chamber 53 and on to (typically) diverter 25 as shown in FIG. 1. Venturi 50 receives high air velocity through conduit 51 which forces balls 12 upwardly as shown in FIG. 1.

Figure 4:
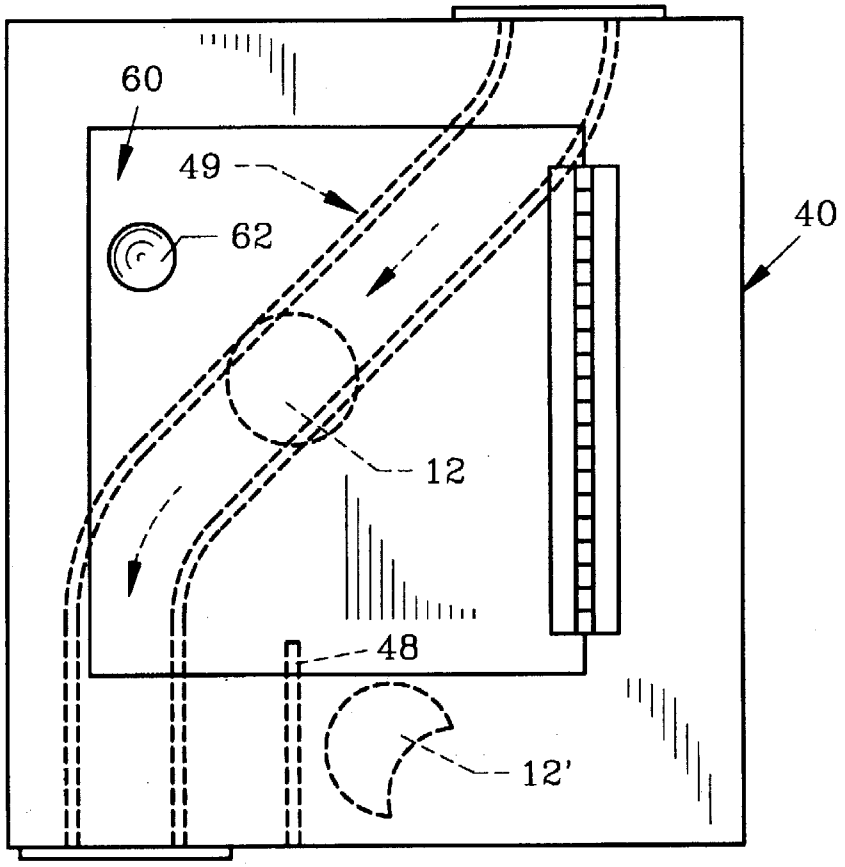
FIG. 4 features a schematic enlarged view of the ball detector as used with the ball washer of FIG. 3.

In FIG. 3 also, balls 12 enter ball detector 40, and move through ball chute 49. Ball chute 49 is formed from a series of exact spaced rods (spaced to contain the particular diameter balls utilized) shown schematically without side rods which, in the event ball 12 is bent or damaged, (balls 12') fall through chute 49 due to their lessened diameter, where they can be later collected as needed by opening hinged door 60 by manually pulling knob 62 (FIG. 4) as shown. Divider 48 forms a collection area for damaged balls 12'. Thereafter, balls 12 move through conduit 47 and pass to brush 55 where they travel in a circular cleaning path and exit through venturi 50 as aforedescribed. While balls 12 are cleaned by brush 55, sprayer 99 directs a mist thereto. As previously explained, balls 12 traveling through venturi 50 are directed generally upwardly through drying chamber 53 and through conduit 20 (FIG. 1) to diverter 25, as seen in FIGS. 5A and 5B.

Diverter 25, as shown without the top track member or rod in FIG. 5A, consists of single ball inlet 70 and a pair of ball outlets 71, 71'. Typically, diverter 25 would include track members 72, 72', 73, 73' and 74 74' consisting of cylindrical rods shaped to allow balls 12 to roll thereon. In order to control the direction of ball 12 to a desired outlet (71, 71'), diverter 25 utilizes solenoids 77, 77' which control the movement of gate 78. As seen in FIG. 6, gate 78 is attached to pivot post 79 which in turn is joined to pivot plate 80. Plate 80 rotates around pivot post 79 by the movements of solenoids 77 and 77' through linkages, 81, 81'. Thus, incoming balls 12 passing through inlet 70 can be diverted either through outlet 71 or outlet 71' by the movement of gate 78 which is electrically controlled by a switch (not shown) attached to electric circuitry within control box 43. In FIG. 5B, also shown without the top rod, gate 78 is turned so as to direct balls 12 through outlet 71' whereas in FIG. 5A, gate 78 is turned so as to direct balls 12 through outlet 71'. An end view of outlet 71 along 5C—5C of FIG. 5B is seen in FIG. 5C, and a side view of diverter 25 is seen in FIG. 6.

Outlets 71 and 71' are connected to a track assembly such as track assembly 100 as shown in FIG. 7. Track assembly 100 utilizes four cylindrically-shaped metal rods 102 formed from aluminum, steel or the like, and are attached along the inner circumference of rod guides 101, 101' such as by welding as seen in FIG. 9. Rods 102 may be, for example, approximately 65 cms in length, and assembly 100 can be bolted to other track assemblies as shown loosened in FIG. 8, by bolts 103, passing though openings 105 as shown in FIG. 9 to form tracks 30, 30' of FIG. 1. To maintain the structural integrity of the track assemblies when using longer rods, additional rod guides 101 may be attached at approximate 65 cm intervals along the rods as needed. A curved track assembly 107 is shown in FIG. 10 and, of course, other shapes and configurations can likewise be formed. As would be understood, various size balls 12 can be used with track assembly 100, for example within the 70–85 mm diameter range. Rod guides 101, 101' are formed typically from 14 gauge sheet metal whereas rods 102 are formed from number 3 gauge wire. As earlier discussed, used and soiled balls 12 are directed from typically, ball pools 11, 11' through tubing 18, 19 to converger 14. Tubing 18, 19 may be a transparent polymeric tubing such as acetate butyrate which is smooth and suitable for ball 12 movement therethrough. Typical tubing may have a 90 mm inside diameter and be of a transparent or opaque polymeric material such as acetate butyrate or other suitable plastics such as acrylics or polycarbonates.

In FIG. 11, converger 14 includes metal housing 151 which may be formed from thin gauge sheet metal or the like. Flexible tubing 152 is dimensioned to pass balls 12 therethrough with ease and convenience. Typically, converger inlets 153 and 153' are in communication with ball pools such as ball pools 11, 11' by means of polymeric tubing 18, 19 as seen in FIG. 1. Contained within housing 151 proximate inlets 153, 153' is conventional linear actuator 154. Actuator 154 if joined to tubing flange 155 and moves within housing 151 from inlet 153 to inlet 153'. Tubing flange 155 is driven by linear actuator 154 along rotating elongated member 156. As further shown in FIG. 11, fractional electric horsepower motor 157 which is controlled through electrical control box 43, as seen in FIG. 2, rotates to turn belt 158 in either of a selected clockwise or counter-clockwise direction. Belt 158 is joined to pulley 159 which is fastened to elongated member 156. Thus, as motor 157 turns, bearings 169 rotate to trace a helix pattern causing activator 154 to move along elongated member 156. Flange 155 with outlet tube 152 affixed, is therefore moved to either of the selected inlets 153 or 153' to receive balls 12 therethrough and discharges them through outlet 160 which is joined to tubing 17 as seen in FIG. 1.

The illustrations and examples provided herein are for explanatory purposes and are not intended to limit the scope of the appended claims.

I claim:

1. A ball cleaning system comprising: a source of balls, a converger, said converger in communication with said ball source, a ball washer, said ball washer in vacuum communication with said converger whereby balls can be delivered from said ball source to said ball washer.

2. The ball cleaning system of claim 1 further comprising a diverter, said ball washer in communication with said diverter, and said diverter in communication with said ball source.

3. The ball cleaning system of claim 2, further comprising a track assembly, and wherein said diverter communicates with said ball washer and with said ball source by said track assembly.

4. The ball cleaning system of claim 1 further comprising a second source of balls, said second ball source in communication with said converger.

5. The ball cleaning system of claim 1 wherein said converger is in vacuum communication with said ball source.

6. The ball cleaning system of claim 1 wherein said ball washer communicates with said converger by a tubular member.

7. A ball washer comprising: a cabinet frame, a rotatable brush positioned within said cabinet frame, said brush for washing balls, a sealed brush compartment, said brush contained within said brush compartment, a fan, said fan positioned within said cabinet frame and applying a negative pressure to said brush compartment, a venturi, said fan applying a positive pressure to said venturi, said venturi in communication with said brush compartment and with said fan whereby said negative pressure directs balls into said brush compartment and said positive pressure directs balls from the ball washer.

8. The ball washer of claim 7 further comprising a ball detector said ball detector in communication with said brush compartment.

9. The ball washer of claim 7 further comprising an electrical control box, said electrical control box affixed to said cabinet frame.

10. A ball cleaning system comprising: a source of balls, a converger, a ball washer, said converger in vacuum communication with said ball washer, said ball washer comprising a negative pressure source and a positive pressure source, means communicating negative pressure to said ball source from said ball washer, said communicating means attached to said ball washer, a venturi, said venturi communicating with said ball washer and said positive pressure source, whereby balls from said ball source can be delivered to said ball washer for cleaning and exit said ball washer through said venturi.

11. The ball cleaning system of claim 10 wherein said ball washer comprises a brush operated washer.

12. The ball cleaning system of claim 10 wherein said communicating means comprises a hose.

13. The ball cleaning system of claim 10 wherein said negative pressure source comprises a fan.

* * * * *